US005547107A

United States Patent [19]

Boiardi

[11] Patent Number: 5,547,107

[45] Date of Patent: Aug. 20, 1996

[54] DISPENSER FOR FLOWABLE MATERIALS

[75] Inventor: Mario Boiardi, Queenstown, Md.

[73] Assignee: Package Research, Inc., Cleveland, Ohio

[21] Appl. No.: 094

[22] Filed: Jan. 4, 1993

[51] Int. Cl.[6] ..... B67D 5/00

[52] U.S. Cl. ..... 222/1; 222/320; 222/327; 222/386

[58] Field of Search ..... 222/1, 326, 327, 222/319, 320, 386, 405, 162

[56] References Cited

U.S. PATENT DOCUMENTS

| | | | |
|---|---|---|---|
| 1,751,128 | 3/1930 | Cocks | 222/327 |
| 2,079,744 | 5/1937 | Maguire | 222/326 |
| 2,752,074 | 6/1956 | Martin | 222/326 |
| 2,758,758 | 8/1956 | Schimpf | 222/327 |
| 2,943,768 | 7/1960 | Lindsay | 222/327 |
| 3,341,084 | 9/1967 | Sundholm | 222/326 X |
| 3,472,433 | 10/1969 | Thomas | 222/326 X |
| 3,493,147 | 2/1970 | Ballia . | |
| 3,767,085 | 10/1973 | Cannon et al. | 222/327 X |
| 4,848,598 | 7/1989 | McKinney | 222/326 X |
| 5,044,525 | 9/1991 | McKinney | 222/326 |
| 5,092,496 | 3/1992 | Gayle et al. . | |
| 5,289,949 | 3/1994 | Gentile | 222/327 X |
| 5,295,615 | 3/1994 | Gentile | 222/386 X |
| 5,335,827 | 8/1994 | Gentile | 222/327 X |

*Primary Examiner*—Kevin P. Shaver
*Attorney, Agent, or Firm*—Connolly & Hutz

[57] ABSTRACT

A dispenser for flowable materials includes an outer barrel which is telescoped over a plunger. A piston head may be separate and distinct member from the plunger itself and may be prepackaged in the barrel with the material to be dispensed located in a chamber above the piston head. When the barrel is telescoped over the plunger, the piston head seats on the plunger and forces fluid from a dispensing spout in the barrel. The piston head carries a sealing rim which creates a seal as the barrel is moved downwardly on the plunger. The barrel may be in the form of a cartridge mounted in a jacket-like holder with a seal between the cartridge and holder.

4 Claims, 6 Drawing Sheets

DISPENSER FOR FLOWABLE MATERIALS

BACKGROUND OF THE INVENTION

U.S. Pat. No. 5,092,496 discloses a dispenser for flowable materials in a barrel. A piston having a flexible sealing rim is telescoped in the barrel. The sealing rim operates in a manner whereby as the barrel is moved downwardly on the piston the pressure from the material in the barrel causes the sealing rim to pivot so as to create sealing surface contact between the sealing rim and the inner surface of the barrel thereby assuring that material will not leak past the sealing rim.

It would be desirable if a dispenser of the type disclosed in U.S. Pat. No. 5,092,496 could be used which would permit reuse of the piston and replacement of simply the barrel with its contents when the contents have been completely expelled from the barrel.

SUMMARY OF THE INVENTION

An object of this invention is to provide a dispenser for flowable materials which meets the above needs.

A further object of this invention is to provide such a dispenser wherein the piston or plunger could be reused after the contents have been fully dispensed by discarding the original barrel and replacing it with a new barrel containing fresh material.

In accordance with one practice of this invention a dispenser for flowable materials is in the form of a outer barrel which contains the flowable materials. A plunger is provided which would be mounted on its end on a support surface. The piston head would be a member separate from the plunger and would be prepackaged in the lower portion of the barrel. The preassembled unit of the barrel containing the flowable material and the piston head could be sold as a separate unit which would be used by mounting the barrel over the plunger so that the piston head seats on top of the plunger. Material would be dispensed from a spout in the barrel by pressing downwardly on the barrel with a sealing rim on the piston head acting in response to pressure from the material to create sealing contact with the inner surface of the barrel.

Alternatively, the piston head could be made integral with the plunger and the barrel itself could be prepackaged. The barrel could be provided with a series of vent openings at its lower end so that when the barrel is assembled over the plunger, air between the flowable material and the open end of the barrel could be expelled during the initial downward movement of the barrel over the plunger.

In a further practice of this invention the barrel may be of two piece construction consisting of an inner cartridge and an outer holder in the form of a jacket which generally encloses the cartridge. A peripheral seal is provided between the cartridge and the holder at the dispensing end of the barrel to prevent flowable substances from leaking into the annular space between the cartridge and holder.

In a preferred practice of this invention the flowable material is toothpaste. The assembly of the barrel and piston head may include a sealing strip which detachably covers the lower end of the barrel to maintain the piston head and flowable material in a sterile condition.

THE DRAWINGS

DETAILED DESCRIPTION

The present invention relates to variations of a dispenser for flowable materials of the type shown in U.S. Pat. No. 5,092,496, the details of which are incorporated herein by reference thereto. In general, in accordance with one practice of this invention which is illustrated in FIGS. 1–6, the dispenser includes a piston head which is distinct from the plunger so that the piston head could be mounted within the barrel to maintain the flowable material in the barrel. As a result the piston head could be prepackaged with the barrel and flowable material as a replacement item. In general, after the contents have been fully dispensed from such a dispenser, the used barrel and piston head are detached from the plunger and discarded. A new unit comprising the barrel with new flowable material and a piston head would then be assembled on the plunger so that the same plunger could be repeatedly reused.

As shown in FIGS. 1–6, the dispenser 10 includes a barrel or sleeve 12 having a closed cap portion 14 at its upper end and a flared lower end 18.

Figure 2:
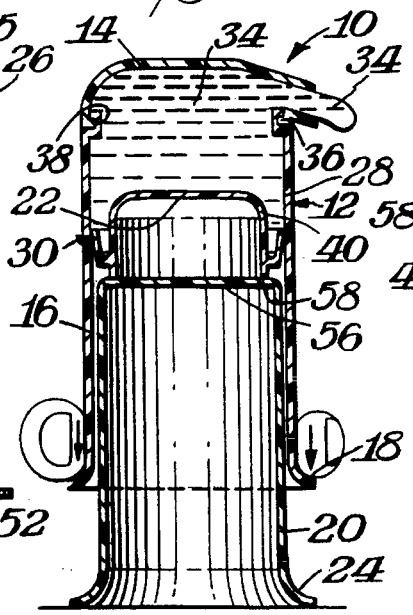
FIG. 2 is a cross sectional view in elevation showing use of the dispenser of FIG. 1.
Figure 3:
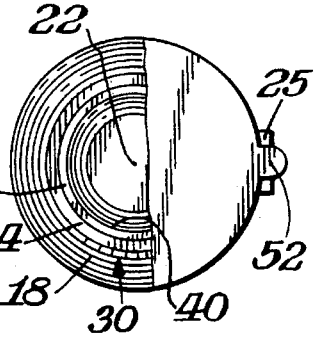
FIG. 3 is a bottom plan view partly broken away of the dispenser shown in FIGS. 1–2.
Figure 4:
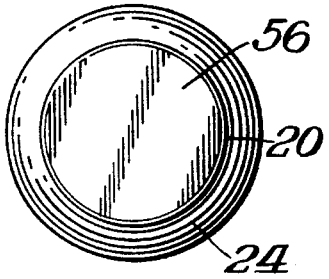
FIG. 4 is a bottom plan view of the plunger shown in FIGS. 1–3.
Figure 5:
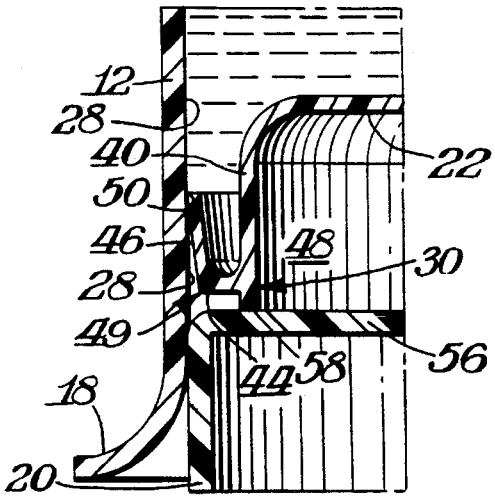
FIG. 5 is a cross-sectional view in elevation on an enlarged scale of a portion of the dispenser shown in FIGS. 1–4.

A piston or plunger 20 is also illustrated as a separate element from barrel 12. As shown in FIGS. 2 and 5 plunger 20 is telescoped into the tubular barrel 12 so that the plunger, in cooperation with piston head 22, functions to expel the flowable material 34 from the spout 25 in cap portion 14 of barrel 12. The material 34 may be toothpaste dispensed onto a toothbrush. As illustrated in FIG. 2, the plunger 10 thus moves within the lower cylindrical portion 16 of barrel 12 when a downward pressure is applied to the flared end 18 of barrel 12.

Figure 1:
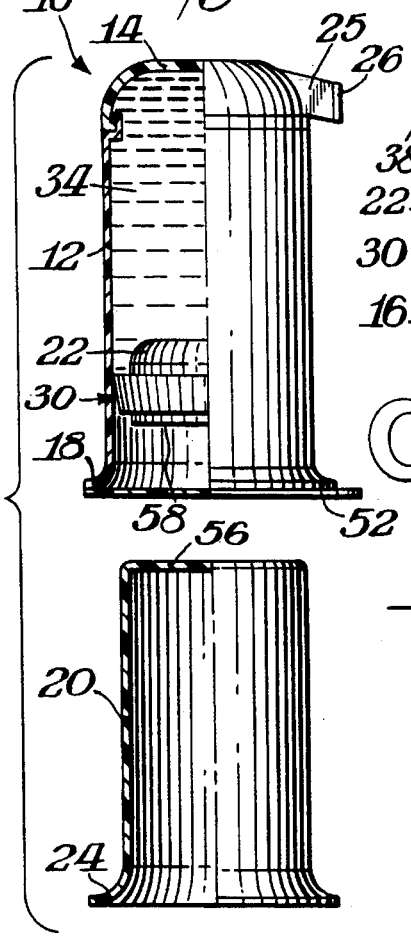
FIG. 1 is an assembly view partially in section of a dispenser in accordance with this invention.

Any suitable closure such as closure 26 shown in FIG. 1 may be used to close spout 25 during periods of nonuse.

As best illustrated in FIGS. 1–2 cap portion 14 is secured to lower cylindrical portion 16 by means of a flange 36 snapped into groove 38.

An advantageous feature of dispenser 10 is the provision of a sealing rim 30 which is described in detail in U.S. Pat. No. 5,092,496. As shown in FIG. 5, sealing rim 30 has an outward extension from the boss 40 of piston head 22. The outward extension is defined by a lower wall 44 and a cup shaped upper wall 48, thus resulting in an intermediate portion 49 which terminates in an outer wall 46. Cup shaped upper surface 44 and the lower surface 48 create a hinge area for sealing rim 30. In response to pressure from the flowable material 34 as piston head 22 is moved upwardly into barrel 12, upper corner 50 of sealing rim 30 is forced into sealing contact with the inner surface 28 of barrel 12.

As illustrated plunger 20 has an outwardly flared lower end 24 which would rest on a support surface and provide greater stability to plunger 20 while barrel 12 is being moved downwardly to dispense the material 34 from spout 25.

The present invention is based upon the recognition that the provision of sealing means such as the sealing rim described above is such that it is possible to make the piston head as a member separate and distinct from the plunger rather than as a integral part of the plunger as described in U.S. Pat. No. 5,092,496. By making piston head 22 separate from plunger 20 it is possible to prepackage the piston head 22 inside barrel 12 so that fresh flowable material 34 could be held in a relatively sealed chamber created between cap portion 14 and piston head 22. If desired, a sanitary cover strip 52 may be applied to the lower end of barrel 12 to completely close barrel 12 and thus maintain the interior of barrel 12 including the flowable material and the piston head 22 in a sterile condition. This permits the plunger 20 and the barrel 12 with its flowable material 34 and piston head 22 to be sold as separate units.

As best illustrated in FIG. 5 the upper end of plunger 20 has a wall 56 which preferably although not necessarily completely closes the upper end of plunger 20. Piston head 22 includes a flange 58 extending below intermediate portion 49 so as to provide a clearance between lower wall 44 of intermediate portion 49 and the upper wall 56 of plunger 20 thereby permitting the hinged action previously described. Flange 58 seats on upper wall 56 thereby causing piston head 22 and plunger 20 to function as a unit during the relative movement of barrel 12 in a downward direction such as shown in FIG. 2.

Figure 6:
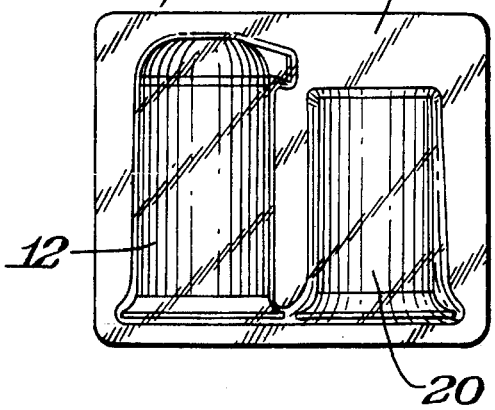
FIG. 6 is a plan view of a package showing the components of the dispenser shown in FIGS. 1–5 in their packaged condition.

FIG. 6 illustrates a prepackaged dispenser wherein the plunger 20 is in a portion of a bubble pack 54 with the barrel unit being in another portion of bubble pack 54. Thus, the components of dispenser 10 could be sold as a kit. Preferably, separate packages would be used for the plunger 20 and the barrel unit 12 containing flowable material 34 and piston head 22. Separate packaging would be desired so that when the contents are completely dispelled from a dispenser the same plunger 20 could be reused by simply purchasing a new unit containing a different barrel 12 with fresh material 34 and its own piston head 22. The new barrel with its new components would be assembled over plunger 20.

Because plunger 20 would be reused with different barrels 12 the invention includes the possibility of forming a decorative theme which may be changed by the assembly of a new barrel 12 on plunger 20. For example, plunger 20 could be made to simulate the trunk of a tree and various forms of barrels 12 could change the upper portion of the tree. Similarly plunger 20 could be in the form of simulated legs which would be used in association with different simulated animal bodies which would be the shape of plunger 12.

It is to be understood that although the invention has been specifically described with respect to the plunger 20 being mounted on a support surface and the barrel 12 being moved downwardly on plunger 20, the invention may also be practiced where the barrel is held in a stationary position and the plunger is moved inwardly into barrel 12.

Figure 7:
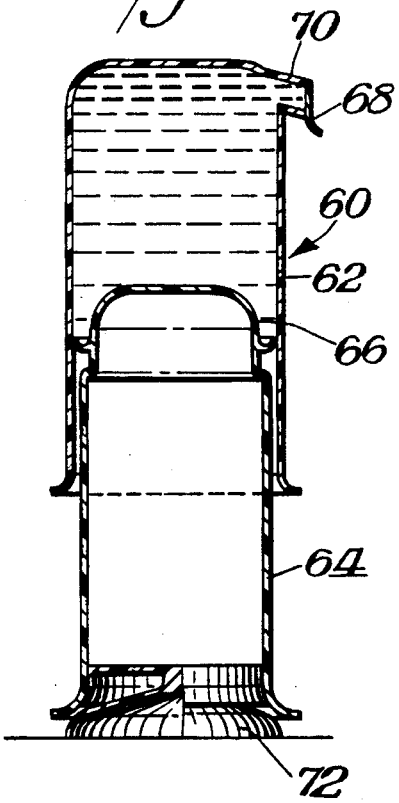
FIG. 7 is a cross-sectional view in elevation showing an alternative view of dispenser in accordance with this invention.

FIG. 7 illustrates a modified form of dispenser 60 which includes a barrel 62 and a piston or plunger 64. In this embodiment the piston head 66 is integral with plunger 64 similar to the arrangement in U.S. Pat. 5,092,496. Barrel 62 includes a suitable closure, such as a sealing strip 68 to close its dispensing spout 70. A further feature of dispenser 60 is in the provision of some mounting means such as a suction cup 72 connected to plunger 64 for firmly mounting plunger 64 on a support surface.

Figure 8:
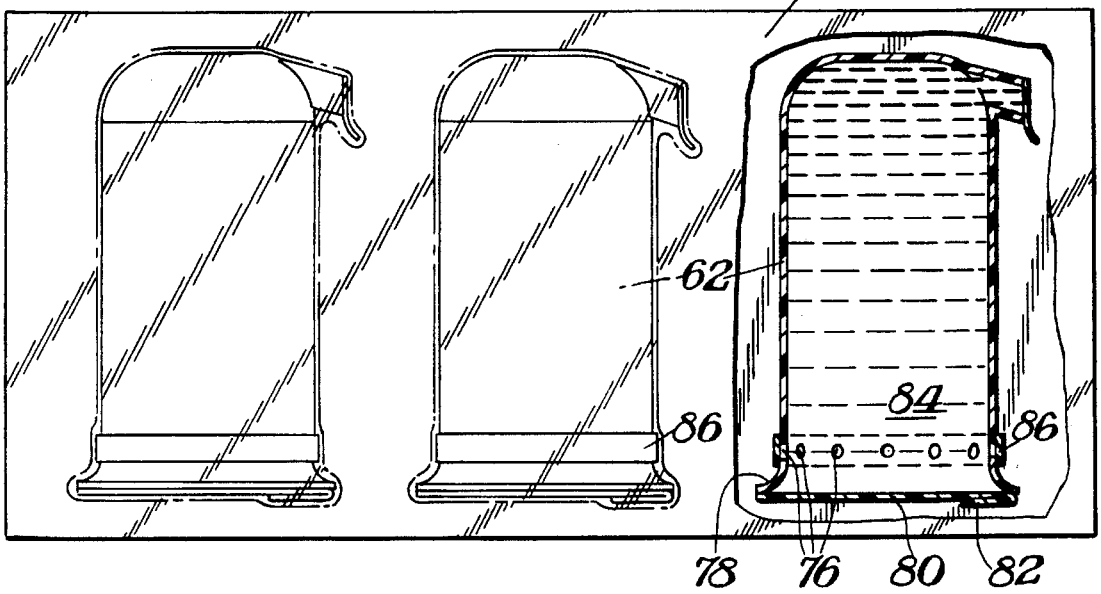
FIG. 8 is an elevational view partly broken away and in section showing a series of prepackaged barrels in accordance with this invention.

FIG. 8 shows a package 74 that would be used for prepackaging a plurality of barrels 62 such as in individual bubbles as is known in the packaging art. FIG. 8 also illustrates a further feature of barrel 62 in that it includes a plurality of vent holes 76 at the lower open flared end 78 of barrel 62. The lower open end is closed in any suitable manner such as by a sealing strip 80 having a pull tab 82. To further assure maintaining the contents 84 in a sterile condition a removable sealing strip 86 could be provided around vent holes 76.

In practice with the use of dispenser 60 when it is desired to replace a used barrel 62 with a new barrel 62 a new barrel would be removed from package 74. Sealing strips 80 and 86 would be removed from barrel 62. Barrel 62 would then be placed over plunger 64 and pushed downwardly. Any air trapped between piston head 66 and the material 84 in barrel 62 would be expelled through vent holes 76. Barrel 62 would be pushed until there is contact between piston head 66 and the material 84 in barrel 62.

Figure 9:
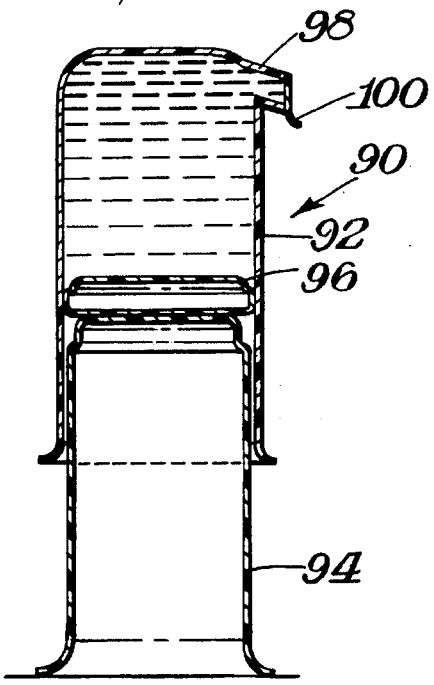
FIG. 9 is a cross-sectional view in elevation of yet another form of dispenser in accordance with this invention.

FIG. 9 shows a dispenser 90 similar to the dispenser 10 of FIGS. 1–5 in that dispenser 90 includes a barrel 92 mounted over a plunger 94 with a separate piston head 96. The spout 98 is closed by sealing strip 100. It is to be understood that the various piston heads such as piston head 96 described herein are of the type illustrated in FIG. 5 in that each piston head includes the sealing lip shown therein. The invention, however, may be practiced with other forms of piston heads in the various embodiments herein.

Figure 10:
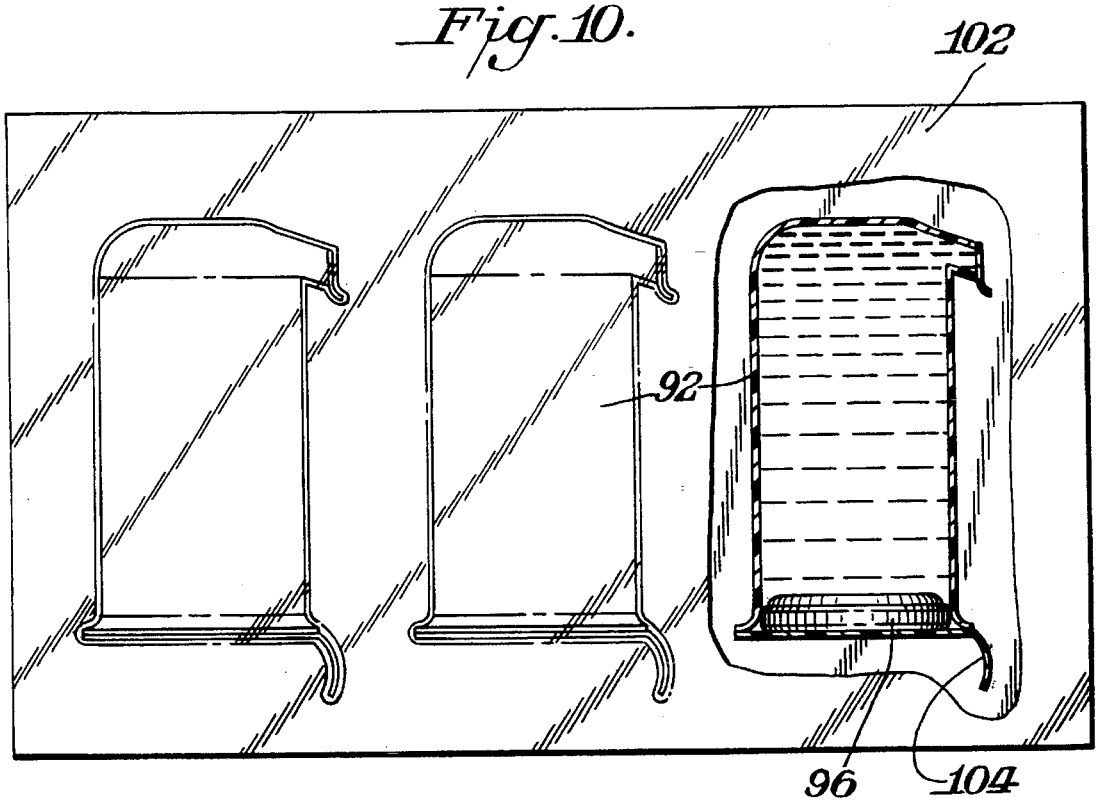
FIG. 10 is a view similar to FIG. 8 showing an alternative prepackaged barrel in accordance with this invention.

FIG. 10 illustrates a package 102 in which a plurality of barrels or cartridges 92 are prepackaged in the manner previously described. As shown therein each barrel or cartridge is prepackaged with a piston head 96 mounted in the barrel. Although not illustrated, if desired, vent holes may also be provided. A sealing strip 104 closes the lower end of barrel 92 to assure the interior of barrel 92 remaining in a sterile condition.

Figure 11:
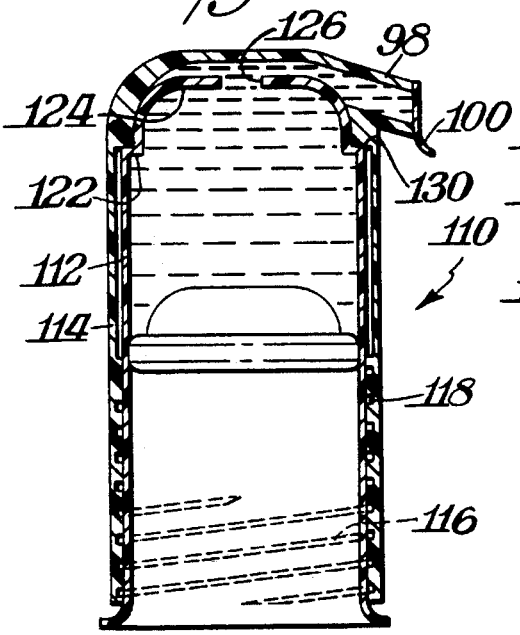
FIG. 11 is a cross-sectional view in elevation of a modified form of barrel consisting of a cartridge and a holder in accordance with a further form of this invention.

FIG. 11 illustrates a further variation of this invention which may be used in connection with other embodiments thereof. As shown therein the barrel 110 is of two piece construction. The inner member is a cartridge 112 which is encapsulated within an outer jacket like holder 114. The use of a two piece barrel provides the possibility of reusing the holder 114 and only replacing the inner cartridge 112. In this practice of the invention it is preferred that some means be utilized to releasably maintain the cartridge 112 and its holder 114 mounted together as a unit and then later permit the cartridge and holder to be separated from each other so that a new cartridge may be inserted. FIG. 11 illustrates the incorporation of screw threads 116 on the outer surface of cartridge 112 which engages a corresponding screw groove 118 on the inner surface holder 114. Thus, the cartridge and holder may be assembled together by screwing the cartridge into the holder until it is properly in place. The cartridge 112 may later be removed from holder 114 by unscrewing the cartridge.

Figure 12:
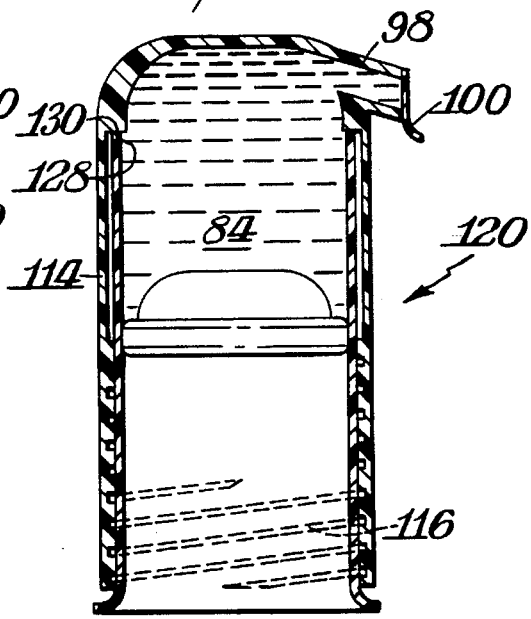
FIG. 12 is a cross-sectional view in elevation showing a variation of the cartridge and holder assembly shown in FIG. 11.

FIG. 12 illustrates a barrel 120 which is a variation of the barrel 110 with respect to the structure near the dispensing end of the barrel. As shown in FIG. 11 barrel 112 includes a shoulder 122 and a dome portion 124 with a central opening 126 communicating with a passageway leading to spout 98. The barrel 120 of FIG. 12, however, terminates at its upper end 128 adjacent the shoulder 130 of holder 114. Otherwise, barrels 110 and 120 are the same. In both of these embodiments the contact of the shoulder 130 of holder 114 with a portion of the cartridge to act as a seal and prevent any leakage of the flowable material 84 into the annular space between the cartridge and holder.

Figure 13:
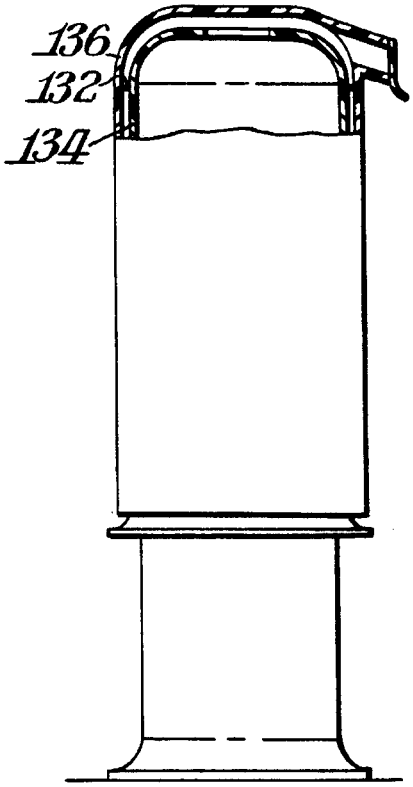
FIG. 13 is a side elevational view partly broken away and in section of yet another dispenser in accordance with this invention.
Figure 14:
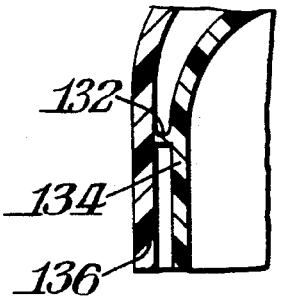
FIG. 14 is an enlarged view of the seal in the dispenser of FIG. 13.

FIGS. 13–14 illustrate a variation in seal construction for preventing leakage of material between the cartridge and holder. As shown therein, an annular sealing lip 132 which is of any suitable construction and could be of the same general construction as sealing rim 130 is provided between the outer surface of cartridge 134 and the inner surface of holder 136. The sealing lip 132 could be integral with cartridge 134 as shown in FIG. 14 or could be integral with holder 136.

Figure 15:
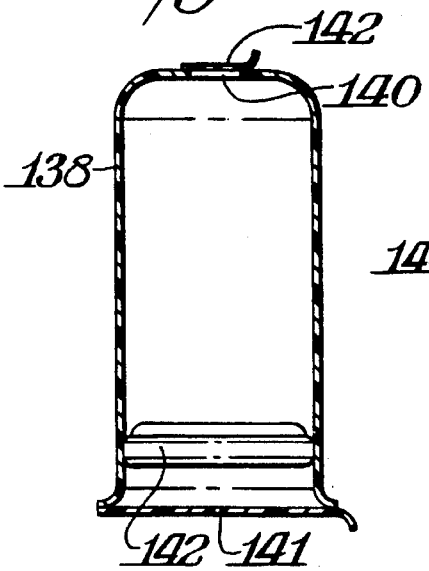
FIGS. 15–17 are cross-sectional views in elevation of modified forms of cartridges in accordance with this invention.
Figure 16:
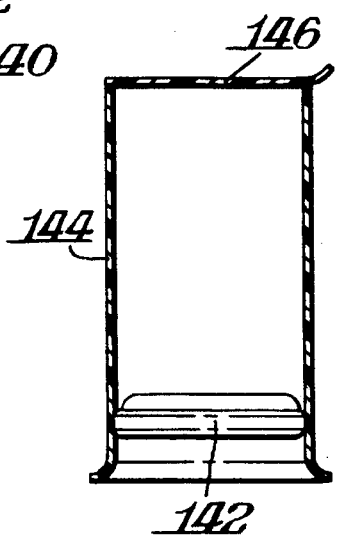
Figure 17:
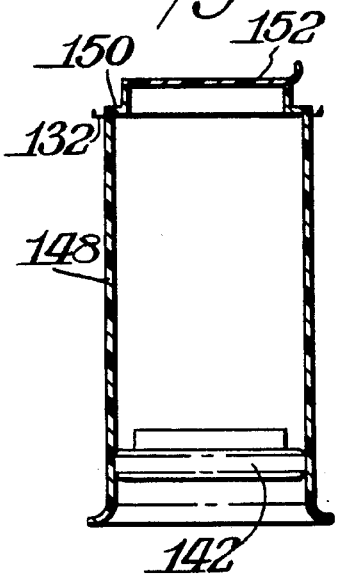

FIGS. 15–17 illustrate alternative forms of cartridges which may be used in accordance with this invention and which are shown in their prepackaged condition. As shown in FIG. 15 the cartridge 138 includes a sealing strip 141 at its lower end and has a piston head 142 mounted therein. The upper end of cartridge 138 is dome shaped and has a central dispensing opening 140 closed by a sealing strip 142.

The cartridge 144 shown in FIG. 16 is similar to the cartridge illustrated in FIG. 12 and includes a sealing strip 146 which closes its upper end with the piston head 142 mounted in the cartridge. Although not illustrated each of these cartridges 138 and 144 would include flowable material. If desired, a sealing strip similar to sealing strip 141 could close the lower end of cartridge 144.

FIG. 17 illustrates a cartridge 148 having a step shoulder 150 with an annular sealing strip 132. The upper end is closed by sealing strip 152.

Figure 18:
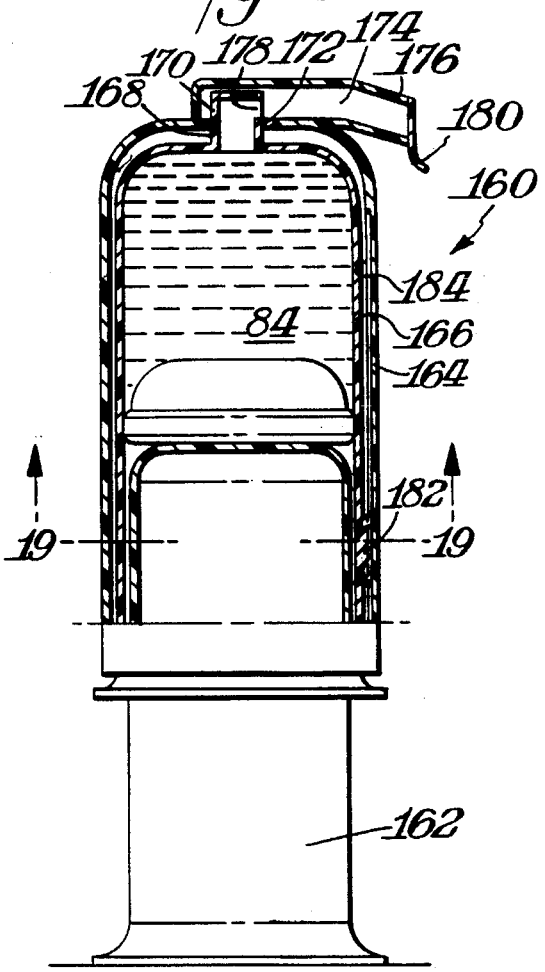
FIG. 18 is an elevational view partly in section of yet another form of dispenser in accordance with this invention.
Figure 19:
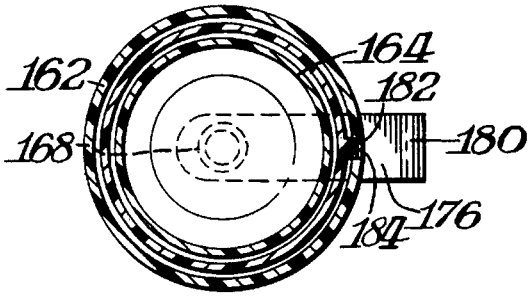
FIG. 19 is a cross-sectional view taken through FIG. 18 along the line 19—19.

FIGS. 18–19 illustrate a further variation of this invention wherein the dispenser 160 includes a plunger 162 and a barrel in the form of a two piece unit comprising cartridge 164 and holder 166. In order to prevent flowable material from passing into the space between cartridge 164 and holder 166, cartridge 164 is provided with an upstanding tubular extension 168 which makes sealing contact with the edges 170, 172 of the passageway 174 leading to spout 176. Tubular member 168 itself includes a dispensing opening 178 which communicates with passageway 174. Spout 176 is closed by a sealing strip 180.

In the embodiment of FIGS. 18–19 it is essential that the dispensing opening 178 of discharge tube 168 be properly oriented to dispense the material 84 directly into passageway 174. In order to assure proper alignment between cartridge 164 and holder 166 some form of aligning means is utilized. In the illustrated embodiment the form of aligning means includes a tongue 182 mounted to the outer surface and preferably integral with cartridge 164. Holder 166 in turn includes a groove 184 into which tongue 182 would be inserted. The cartridge 164 and holder 166 would be mounted together by telescoping cartridge 164 into holder 166 when the tongue 182 is inserted into groove 184. The close tolerances would maintain the cartridge and holder mounted together, yet permit their dismounting when it is desired to replace a cartridge.

Figure 20:
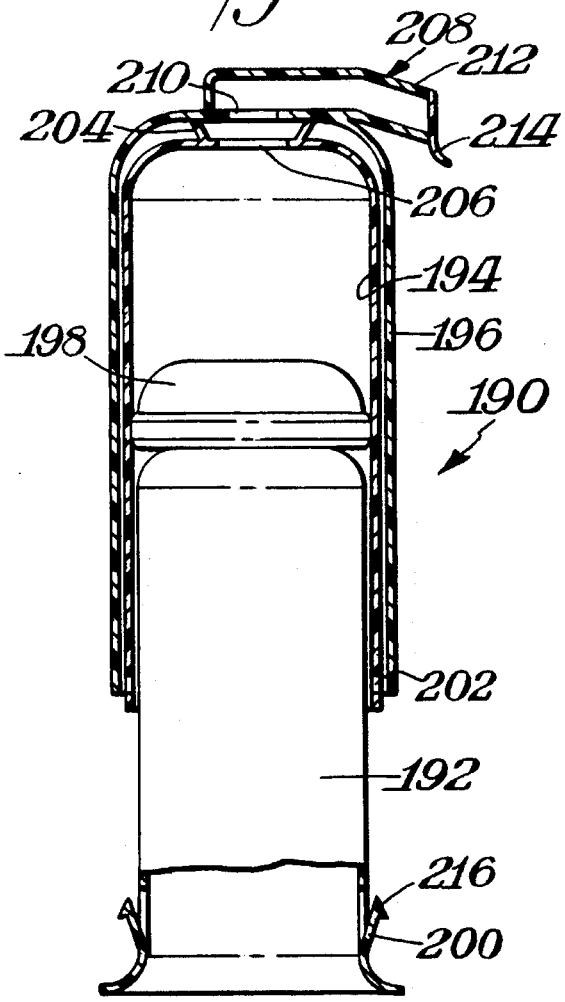
FIG. 20 is an elevational view partly broken away and in section of still yet another form of dispenser in accordance with this invention.
Figure 21:
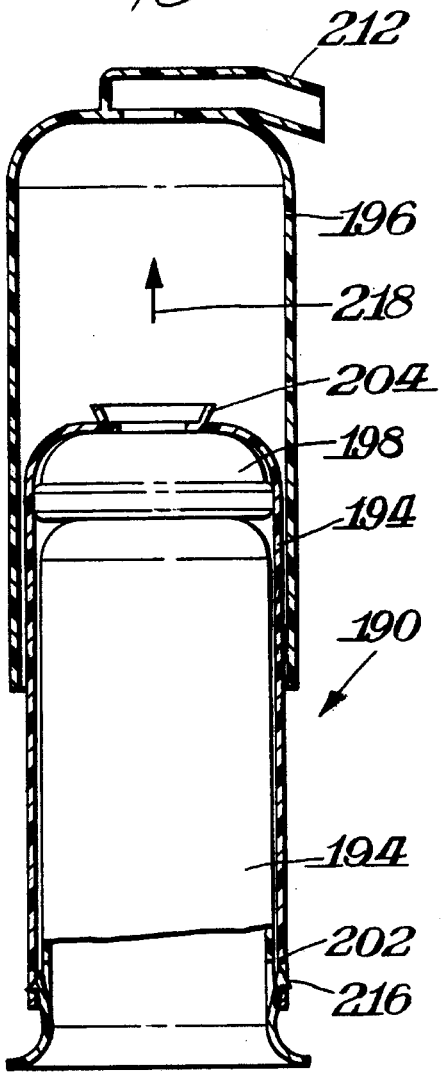
FIG. 21 is a cross-sectional view in elevation of the dispenser shown in FIG. 20 during the holder removal step.
Figure 22:
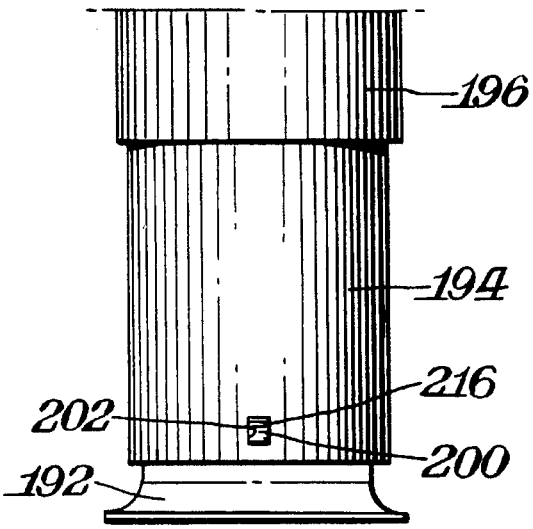
FIG. 22 is an elevational view of the dispenser shown in FIG. 21 illustrating the locking engagement of the plunger and cartridge.

FIGS. 20–22 illustrate yet another variation of this invention for detachably mounting a cartridge to a holder. As shown therein the dispenser 190 includes a plunger 192, a cartridge 194 and a holder 196 with a piston head 198 mounted within cartridge 194. In the illustrated embodiment plunger 192 includes a plurality of resilient hook like projections 200 resiliently biased outwardly from the general cylindrical outer surface of plunger 192. Cartridge 194 includes a plurality of spaced circumferential openings 202 at its lower end. Any suitable form of sealing means, such as annular sealing lip 204 would be provided to prevent material from passing into the open space between cartridge 194 and holder 196. In the illustrated form a dispensing opening 206 is provided in the dome shaped top of cartridge 194 so that the material can flow into dispensing member 208 mounted at the top of holder 196. Dispensing member 208 includes a lower opening 210 in line with the axial opening 206 and terminates in a dispensing spout 212 covered by sealing strip 214 or any other form of cap.

In use of dispenser 190 the cartridge and holder would be mounted together as a unit in any suitable manner, such as resulting from the tight fit between the two members or by other mounting means such as the screw connection. As the material is dispensed from dispenser 190 the barrel unit comprising cartridge 194 and holder 196 gradually moves downwardly on plunger 192. When the material is completely dispensed the barrel unit is in its lower most position. When in that position the hooks 200 enter the corresponding holes or openings 202 in the lower portion of cartridge 194 to lock the cartridge to plunger 192. The pointed end of hook 200 and its inclined surface 216 act as a caming surface to enter into the space between cartridge 196 and plunger 192 and to deflect the hooks 200 inwardly. If necessary, the barrel unit could be rotated to assure proper alignment between the plunger 192 and cartridge 194 so that the hooks are properly aligned with the openings. The form of alignment could be a physical mark on the exposed lower edge of cartridge 192 or if the cartridge and holder are non-rotationally mounted the marks could be on the outer surface of holder 196. These marks would be aligned with the hooks 200. The marks could also be physically formed by grooves or indents in the exposed lower surface of cartridge 194.

After cartridge 194 has been coupled to plunger 192 holder 196 is moved upwardly as shown by the arrow 218 until holder 196 is completely detached from cartridge 194. The hooks 200 are exposed as shown in FIG. 22. Accordingly, the hooks may be depressed inwardly a sufficient extent to then permit the cartridge 194 to be disengaged from the hooks. Cartridge 194 may then be disposed of and the same plunger 194 and holder 196 may be used with a new cartridge. Prior to insertion of the new cartridge into holder 196 the inner surface of the interior of holder 196 may be cleaned of any material that might have accumulated therein, such as near the dispensing portion of holder 196. The new cartridge 194 would be suitably mounted into holder 196 and the resulting barrel assembly would be placed on plunger 192.

The utilization of a two component barrel comprising a cartridge and holder is a particularly advantageous feature of this invention since it permits the same plunger and the same holder to be used with a replacement only of the cartridge. If desired the plunger and holder may be easily cleaned before re-use. This aspect of the invention may be practiced with a separate piston head such as illustrated in FIGS. 18 and 20 or with an integral piston head such as illustrated in FIG. 7. Similarly, where the barrel is shown in various embodiments as a one piece unit it is to be understood that the invention may be practiced by forming the barrel as a two piece unit having a cartridge and holder.

Figure 23:
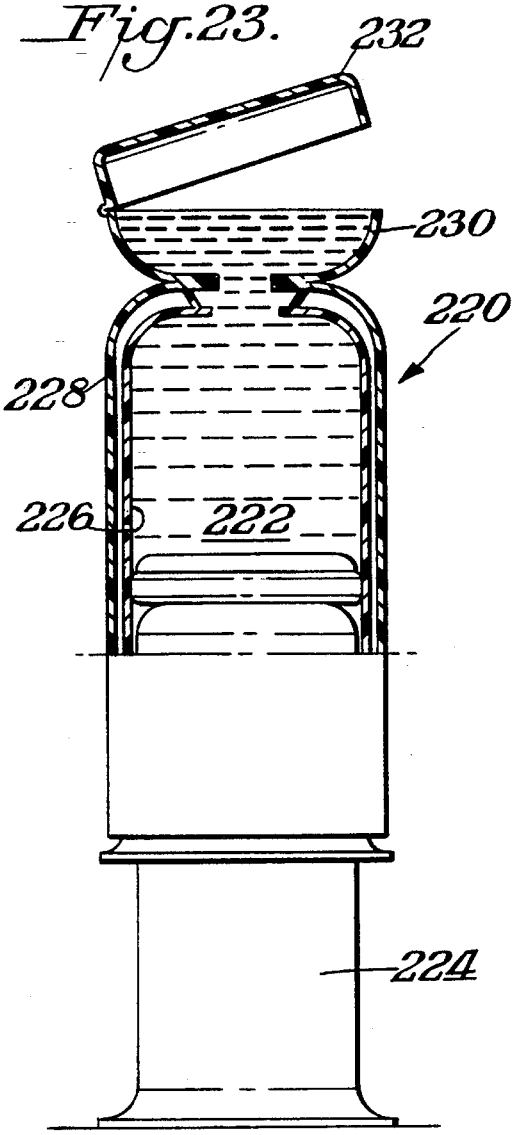
FIG. 23 is an elevational view partly in section of a dispenser in accordance with yet another embodiment of this invention.

Although the description herein has been primarily directed to flowable materials such as toothpaste, the invention may also be practiced for dispensing other forms of materials. FIG. 23, for example, illustrates a modified dispenser 220 which may be used for dispensing some form of cosmetic 222 in liquid or creme form. Dispenser 220 could be formed along the lines previously described or could have the construction shown in FIG. 23 which is particularly adapted for the dispensing of cosmetic creme. As shown therein, dispenser 220 includes a plunger 224 with a barrel formed by a cartridge 226 mounted in holder 228. In the illustrated embodiment the top 230 of holder 220 is of cup shape and has a removable or hinged cap 232 to expose the material 222 disposed in cup 230 so that the material 222 could be removed such as by the fingers and applied to the body. The structure of the holder and cartridge could take any of the previously described forms.

What is claimed is:

1. A method of dispensing toothpaste comprising the steps of providing a barrel in the form of a tubular member having a closed upper end with a dispensing spout and an open lower end, disposing toothpaste in the barrel, closing the barrel by a piston head mounted into the barrel to create a dispensing chamber which is filled with the toothpaste in a prepackaged unit consisting of the barrel and the toothpaste and the piston head, mounting the prepackaged unit on a plunger with the plunger being telescoped into the barrel until the plunger contacts the piston head, dispensing toothpaste from the dispensing spout of the barrel by applying manual pressure for causing relative motion between the barrel with respect to the piston head and plunger, repeating the dispensing until substantially all of the toothpaste is dispensed from the barrel, removing the barrel and piston head from the plunger, inserting a new unit on the plunger with the new unit consisting of a barrel with toothpaste and a piston head, the barrel comprising a cartridge having a dispensing opening covered by a sealing strip and a holder with the holder being reusable and the cartridge being the replaceable part of the barrel, and including the steps of removing the sealing strip to expose the dispensing opening of the cartridge, mounting the cartridge into the holder so that the holder generally encapsulates the cartridge to form a barrel unit, and mounting the barrel unit over the plunger.

2. The method of claim 1 wherein the piston head has a sealing rim and including pressing the sealing rim into sealing contact with the inner surface of the barrel in response to the force applied by the toothpaste material as the piston head and plunger are telescoped more deeply into the barrel.

3. The method of claim 1 wherein the cartridge includes a plurality of vent holes, and expelling air from the cartridge through the vent holes.

4. A method of dispensing toothpaste comprising the steps of providing a barrel in the form of a tubular member having a closed upper end and an open lower end with a dispensing spout, disposing toothpaste in the barrel, closing the barrel by a piston head mounted into the barrel to create a dispensing chamber which is filled with the toothpaste in a prepackaged unit consisting of the barrel and the flowable material and the piston head, mounting the prepackaged unit on a plunger with the plunger being telescoped into the barrel until the plunger contacts the piston head, dispensing toothpaste from the dispensing spout of the barrel by applying manual pressure for causing relative motion between the barrel with respect to the piston head and plunger, expelling air from the barrel through vent holes in the barrel, repeating the dispensing until substantially all of the toothpaste is dispensed from the barrel, removing the barrel and piston head from the plunger, inserting a new unit on the plunger with the new unit consisting of a barrel with toothpaste and a piston head, the barrel comprising a cartridge and a holder with said holder being reusable and said cartridge being the replaceable part of the barrel, and including the steps of mounting the cartridge into the holder so that the holder generally encapsulates the cartridge to form a barrel unit, and mounting the barrel unit over the plunger.

* * * * *